United States Patent [19]

Kajihara et al.

[11] Patent Number: 4,687,969

[45] Date of Patent: Aug. 18, 1987

[54] DISCHARGE TUBE FOR A HIGH PRESSURE METAL VAPOR DISCHARGE LAMP AND A METHOD OF MANUFACTURING THE SAME

[75] Inventors: Takehiro Kajihara, Komaki; Senji Atsumi, Kakamigahara; Hirotsugu Izumiya, Nagoya, all of Japan

[73] Assignee: NGK Insulators, Ltd., Nagoya, Japan

[21] Appl. No.: 757,506

[22] Filed: Jul. 22, 1985

[30] Foreign Application Priority Data

Aug. 31, 1984 [JP] Japan ..... 59-183294

[51] Int. Cl.[4] ..... H01J 17/18; H01J 61/36

[52] U.S. Cl. ..... 313/625; 313/636; 445/26

[58] Field of Search ..... 313/623–625, 313/636; 445/26, 29

[56] References Cited

U.S. PATENT DOCUMENTS

| | | | |
|---|---|---|---|
| 4,503,356 | 3/1985 | Kobayashi et al. | 313/636 X |
| 4,507,584 | 3/1985 | Coaton et al. | 313/625 X |
| 4,563,214 | 1/1986 | Seddon et al. | 313/636 X |

FOREIGN PATENT DOCUMENTS

| | | |
|---|---|---|
| 35507 | 10/1969 | Australia . |
| 0009352 | 2/1980 | European Pat. Off. . |
| 0055532 | 7/1982 | European Pat. Off. . |

OTHER PUBLICATIONS

"Lamps and Lighting", 2nd Ed., pp. 244–246, Henderson & Marsden Ed., Edward Arnold Publishers, London, 1975.

*Primary Examiner*—Palmer C. DeMeo
*Assistant Examiner*—Sandra L. O'Shea
*Attorney, Agent, or Firm*—Parkhurst & Oliff

[57] ABSTRACT

Disclosed herein is a discharge tube for a high pressure metal vapor discharge lamp, which discharge tube comprises a translucent alumina tubular body, a lower end plate bonded to one end portion of the alumina tubular body which has an electrode support member inside thereof and is bonded to the alumina tubular body when the alumina tubular body is subjected to the light transmission treatment through firing, another end plate which has an electrode support member inside thereof and is bonded to the other end of the translucent alumina tubular body by means of a frit. This discharge tube is produced by inserting an end plate in which an electrode support member is partially embedded on the inner side thereof into one end portion of a tubular body made of high purity alumina, firing the green or calcined tubular body with the end plate, so that the tubular body is made translucent and simultaneously the end plate is bonded to the tubular body, and attaching another end plate to the other end of the alumina tubular body with the frit.

7 Claims, 3 Drawing Figures

DISCHARGE TUBE FOR A HIGH PRESSURE METAL VAPOR DISCHARGE LAMP AND A METHOD OF MANUFACTURING THE SAME

BACKGROUND OF THE INVENTION (1) Field of the Invention

The present invention relates to a high pressure metal vapor discharge lamp, particularly for a metal halide discharge lamp, and a method for manufacturing the same.

(2) Description of the Prior Art

A translucent alumina which withstands corrosive metal halides is used as a tubular body of a discharge tube of the high pressure metal vapor discharge lamp, particularly the metal halide lamp in which the metal halide is sealingly placed, and alumina or cermet is used as end plates adapted to fit electrode support members at end portions of the tubular body. When the discharge tube is produced by assembling these parts together, it is a common practice to bond the end plates by means of a frit (for instance, U.S. Pat. Nos. 3,885,184 and 4,001,625) to the opposite ends of the tubular body made of the alumina which is made translucent through preliminary firing.

However, the use temperature of the discharge tube produced by such a method cannot be sufficiently raised since there is a fear that the frit is corroded with the metal halide, so that the discharge efficacy must unfavorably be suppressed to a level far lower than the theoretical value. In addition, even if such is taken into consideration, only a relatively short durable life can be attained. Therefore, a method which allows easy production of a discharge tube for the metal halide lamp which is high in discharge efficacy and long in the durable life has been being demanded.

SUMMARY OF THE INVENTION

The present invention therefore has been accomplished to resolve the above drawbacks encountered by the prior art, and is to provide a discharge tube for a high pressure metal vapor discharge lamp which is high in discharge efficacy, and long in durable life.

It is another object of the present invention to provide a method of manufacturing a discharge tube for a high pressure metal vapor discharge lamp, which is high in discharge efficacy and long in durable life, which method comprises simplified steps.

According to the first aspect of the present invention, there is a provision of a discharge tube for a high pressure metal vapor discharge lamp, which discharge tube comprises a translucent alumina tubular body, a lower end plate bonded to one end portion of the alumina tubular body which has an electrode support member inside thereof and is bonded to the alumina tubular body when the alumina tube is subjected to the light transmission treatment through firing, another end plate which has an electrode support member inside thereof and is bonded to the other end of the translucent alumina tubular body by means of a frit.

According to a second aspect of the present invention, there is a provision of a method of manufacturing a discharge tube for a high pressure metal vapor discharge lamp, which method comprises steps of inserting an end plate in which an electrode support member is partially embedded on the inner side thereof into one end portion of a tubular body made of high purity alumina, and firing the green or calcined tubular body with the end plate, whereby the tubular body is made translucent and simultaneously the end plate is bonded to the tubular body.

These and other objects, features and advantages of the invention will be well appreciated upon reading of the invention when taken in conjunction with the attached drawings with understanding that some modifications, variations and changes of the invention could be easily made by the skilled persons in the art to which the invention pertains without departing from the spirit of the invention or the scope of the claims appended hereto.

BRIEF DESCRIPTION OF THE DRAWINGS

For better understanding of the invention, reference will be made to the attached drawings, wherein.

DETAILED DESCRIPTION OF THE PREFERRED EMBODIMENTS OF THE INVENTION

Figure 1:
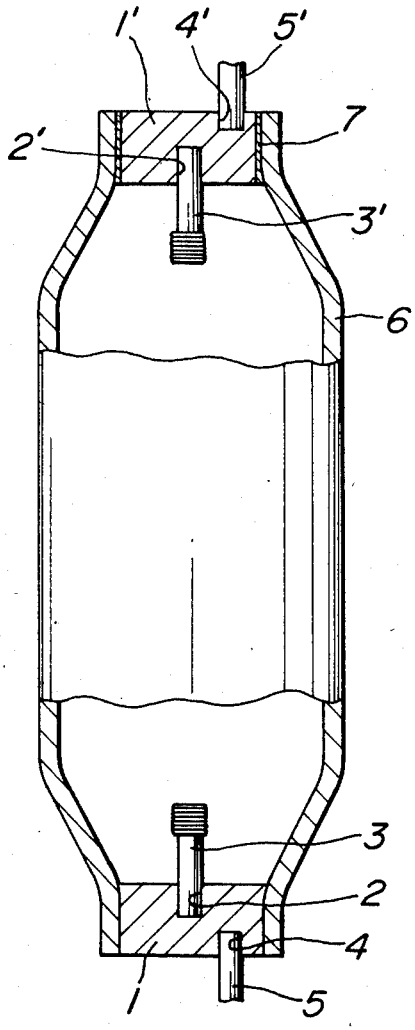
FIG. 1 is a partially cutaway front view of an embodiment of a discharge tube for a high pressure metal vapor discharge lamp according to the present invention.

Now, the invention will be explained more in detail with referring to the attached drawings. Throughout the specification and the drawings, identical reference numerals denote the same or similar parts.

In FIG. 1, there is shown an embodiment of a discharge tube for a high pressure metal vapor discharge lamp in which a reference numeral 1 is an end plate, and a reference numeral 2 is a depression formed on the inner side of the end plate 1 into which an electrode support member 3 is fitted. The end plate 1 is bonded to a tubular body 6 at the lower end thereof while a tubular body 6 become to be translucent through firing. An electric current conducting member 5 is fitted into a depression 4 formed in the end plate 1 at the outer side thereof. An end plate 1' is constituted in the same or similar shape as the end plate 1, and possesses an electrode support member 3' and an electric current conducting member 5'. This end plate is attached to the upper end portion of the discharge tubular body 6 by means of a frit.

Next, a method of manufacturing the discharge tube for the high pressure metal vapor discharge lamp will be described more in detail below.

Figure 2:
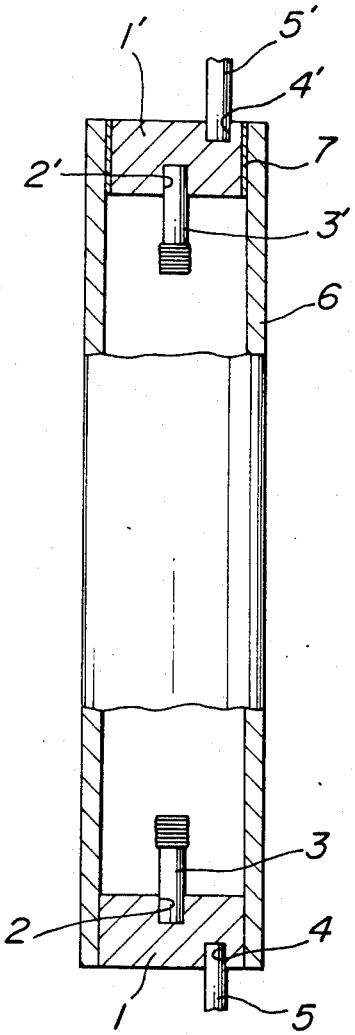
FIGS. 2 and 3 are other modified embodiments of the discharge tube for the high pressure metal vapor discharge lamp according to the present invention.

First, the end plate 1 is formed from a material of an excellent electric conductivity such as alumina-tungsten, alumina-molybdenum tungsten boride. Then, the electrode support member 3 made of tungsten is inserted into the depression 2 provided on the inner side of the end plate 1 and an electric current conductor 5 is inserted into the depression 4 formed on the outer side of the end plate 1. Thereafter, the electrode support member 3 and the electric current conductor 5 are bonded to the end plate 1 through firing. On the other hand, the green tubular body is formed from high purity alumina, and is calcined in air. Then, the above end plate 1 is fitted into one end of the calcined tubular body, and the whole tubular body with the end plate 1 is fired at a high temperature around 1,900° C. with hydrogen gas in a reducing atmosphere electric furnace to make the tubular body to be the translucent tubular body 6 and at the same time firmly bond the end plate 1 to the tubular body 6. Since the firing shrinkage factor of the cermet constituting the end plate 1 is smaller than that of the high purity alumina constituting the tubular body 6, this bonding is carried out in the state of a certain shrinkage fitting, while a gas tight bonding is effected through the sintering phenomenon occurring between the end plate and the high purity alumina. A metal halide is sealingly put into the tubular body 6 to which the end plate is directly bonded at the lower end thereof with using no frit. When the lamp is in operation, the sealed substance becomes liquid, whereby the chemical reactivity increases against the inner surface of the lower end portion. Finally, the end plate 1' equipped with the electrode support member 3' and the electric current conductor 5' which end plate is preliminarily formed in the same way as mentioned above is bonded to the upper end surface of the tubular body 6 by means of a glass frit 7. Needless to say, the profile of the tubular body 6 may be a cylindrical tubular form as shown in FIG. 2 instead of that shown in FIG. 1.

Figure 3:
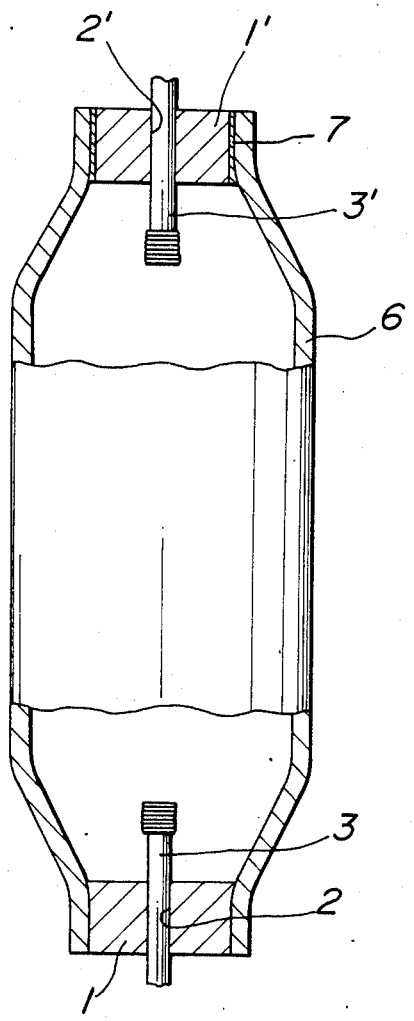

When the electric current conductors 5, 5' of the high pressure metal vapor discharge lamp thus produced are connected to an electric power source (not shown), electric current flows to the electrode support members 3 and 3' through the electric conductive end plates 1 and 1' to effect the discharging. At that time, the sealed substance is changed to liquid, the bonded portion is not corroded with the liquid sealed substance having the high reactivity because the end plate 1 and the tubular body 6 are directly bonded through sintering without using the frit at the end surface of the tubular body. Therefore, the discharge tube can be used at a temperature higher than the use temperature of the conventional discharge tube of the metal halide discharge lamp, higher discharge efficacy can be obtained, while the long durable life can be attained. When the end plates 1 and 1' are made of a non-conductive material, as shown in FIG. 3, the electrode support members 3 and 3' are favorably passed through the end plates 1 and 1' to be projected outwardly. As to the other construction features of the embodiment shown in FIG. 3, they are the same as or similar to those shown in FIGS. 1 and 2. Thus, detailed explanation of the embodiment of FIG. 3 is omitted.

As obvious from the foregoing explanation, since the light transmission treatment by which the green or calcined tubular body made of a high purity alumina is made translucent through firing is carried out simultaneously with the bonding of the end plate with the tubular body, the discharge tube for a high pressure metal vapor discharge lamp having a high discharge efficacy and a longer durable life can be produced. Further, since the firing is not required to be done at plural stages, the production steps of the manufacturing method can be advantageously simplified. Therefore, the present invention can contribute to the development of the relevant industry to a large extent since the invention resolves the problems in the manufacturing methods of producing the discharge tube for the high pressure metal vapor discharge lamp in the prior art.

What is claimed is:

1. A discharge tube for a high pressure metal vapor discharge lamp, comprising:

a translucent alumina tubular body having first and second opposite end portions;

first and second end plates comprised of cermet, said cermet having a firing shrinkage factor which is less than a firing shrinkage factor of the translucent alumina tubular body;

first and second electrode support members, said first support member being partially embedded in the first end plate and said second support member being partially embedded in the second end plate and each of said first and second electrode support members being located inside of the translucent alumina tubular body, said first end plate being fitted to the first opposite end portion of the translucent alumina tubular body and bonded thereto, said first opposite end portion being located at a lower position than the second opposite end portion when the high pressure metal vapor discharge lamp is in use, wherein bonding of the first end plate to the first opposite end portion is achieved by shrinkage fitting of the first end plate into the translucent alumina tubular body during a simultaneous sintering of the first end plate to the translucent alumina tubular body and a simultaneous bonding of said first electrode support member to said first end plate, said bonding occuring when the translucent alumina tubular body is fired to be translucent, said second end plate being fitted to the second opposite end portion of the translucent alumina tubular body and being bonded thereto, said second opposite end portion being located at a vertically higher position than the first opposite end portion when the high pressure metal vapor discharge lamp is in use.

2. A discharge tube for a high pressure metal vapor discharge lamp according to claim 1, wherein the end plates are made of electric conductive cermet.

3. A discharge tube for a high pressure metal vapor discharge lamp according to claim 1, wherein an electric current conductor is bonded to an outer side of said first end plate during said simultaneous sintering.

4. A discharge tube for a high pressure metal vapor discharge lamp according to claim 1, wherein said simultaneous sintering occurs at a temperature of about 1900° C.

5. A method of manufacturing a discharge tube for a high pressure metal discharge lamp, comprising:

inserting a first end plate having a partially embedded electrode support member and a partially embedded electric current conductor into a first end portion of a tubular body, the tubular body comprising high purity alumina, such that the electrode support member may be positioned inside the tubular body and the electric current conductor may be positioed outside the tubular body, said first end plate comprising a cermet which has a firing shrinkage factor which is less than a firing shrinkage factor of the high purity alumina, said first end portion of the tubular body being located at a vertically lower position than a second end portion of the tubular body when the high pressure metal vapor discharge lamp is in use; and firing the tubular body with said first end plate positioned therein, wherein when the tubular body is fired to become translucent, said first end plate is simultaneously shrink fitted inside of the tubular body and sealingly bonded to the tubular body by sintering and the partially embedded electrode support member and electric current conductor are simultaneously bonded to said end plate.

6. A method of manufacturing a discharge tube for a high pressure metal vapor discharge lamp according to claim 5, wherein a second end plate has an electrode support member partially embedded on an inner side thereof, and said second end plate is bonded with a glass frit to a second portion of the translucent alumina tubular body after said firing of the tubular body.

7. A method of manufacturing a discharge tube for a high pressure metal vapor discharge lamp according to claim 5, wherein said firing occurs at a temperature of about 1900° C.

* * * * *